US007406934B2

(12) United States Patent
Mizutani et al.

(10) Patent No.: US 7,406,934 B2
(45) Date of Patent: Aug. 5, 2008

(54) VALVE TIMING CONTROLLER WITH SEPARATING MEMBER

(75) Inventors: Shuji Mizutani, Nagoya (JP); Eiji Isobe, Kariya (JP)

(73) Assignee: DENSO CORPORATION (JP)

( * ) Notice: Subject to any disclaimer, the term of this patent is extended or adjusted under 35 U.S.C. 154(b) by 0 days.

(21) Appl. No.: 11/712,414

(22) Filed: Mar. 1, 2007

(65) Prior Publication Data

US 2007/0209621 A1 Sep. 13, 2007

(30) Foreign Application Priority Data

Mar. 9, 2006 (JP) ..... 2006-064530

(51) Int. Cl.
*F01L 1/34* (2006.01)

(52) U.S. Cl. ..... 123/90.17; 123/90.15; 123/90.31

(58) Field of Classification Search ..... 123/90.17, 123/90.15, 90.31
See application file for complete search history.

(56) References Cited

U.S. PATENT DOCUMENTS 4,733,979 A * 3/1988 Tsuruki ..... 384/620
6,883,482 B2 4/2005 Takenaka et al.

* cited by examiner

*Primary Examiner*—Zelalem Eshete
(74) *Attorney, Agent, or Firm*—Nixon & Vanderhye PC

(57) ABSTRACT

A valve timing controller includes a first rotating element and a second rotating element. The controller further includes a link mechanism part including arm members for coupling the first and second rotating elements. The controller also includes a gear part including a first gear and a second gear to convert outside rotating torque to control torque for motion of the arm members due to coupling of and relative motion of the first and second gears. Additionally, the controller includes a separation member disposed between the gear part and the link mechanism part for separating a thrust gap of the gear part and a thrust gap of the link mechanism part.

6 Claims, 6 Drawing Sheets

VALVE TIMING CONTROLLER WITH SEPARATING MEMBER

CROSS REFERENCE TO RELATED APPLICATION

The following is based on and claims priority to Japanese Patent Application No. 2006-64530, filed Mar. 9, 2006, which is hereby incorporated by reference in its entirety.

TECHNICAL FIELD

The present invention relates to a valve timing controller, and more particularly, to a valve timing controller with a separating member.

BACKGROUND INFORMATION

A valve timing controller is conventionally known for changing a relative rotational phase between two rotating elements that rotate in association with a drive shaft and a camshaft, respectively. For example, JP-2005-48707A discloses a valve timing controller equipped with arm members for linking a first rotating element (a sprocket) with a second rotating element (an output shaft) via a revolute pair. The valve timing controller also includes a phase changing mechanism for changing a relative rotating phase between the first rotating element and the second rotating element. Furthermore, the valve timing controller includes an electric motor for producing rotating torque for a motion of the revolute pair. In addition, the valve timing controller includes a motion converting mechanism for transmitting the rotating torque by the electric motor to the arm members.

The electric motor, the motion converting mechanism, and the phase changing mechanism are axially combined. The motion converting mechanism and the phase changing mechanism are configured in such a manner as to be accommodated in the sprocket.

In addition, the motion converting mechanism is equipped with a gear part including a ring gear and a planetary gear. The planetary gear performs a planetary motion by engaging with the ring gear. The motion converting mechanism also includes a guide member for guiding a movable member, which supports the revolute pair of the arm members around an axis as a controlling object. An engagement projection projecting from the planetary gear is supported by an engagement bore located in the opposite side of the arm members of the guide member. Also, the movable member slides relatively along a guide passage formed in the guide member, thus converting a rotational motion of the motor into a predetermined revolute pair motion of the movable member.

In the conventional technology, the ring gear and the planetary gear engage with each other by several teeth, producing a cantilever state thereof, and therefore there is a possible decline thereof toward a thrust direction. For example, when the decline in the thrust direction occurs, the planetary gear swings in the thrust direction within a thrust gap, and undesirable sound can be result, such as a slapping sound.

Therefore, reduction of the thrust gap is suggested. However, this idea is designed to axially combine a gear part with another member, such as a link mechanism formed of arm members constituting a revolute pair. Accordingly, this idea requires a precision improvement of each member in order to reduce variation of the thrust gap of each member.

SUMMARY

A valve timing controller disposed in a drive system which transmits torque of a drive shaft to a driven shaft for opening and closing of a valve to thereby control opening and closing timing of the valve is disclosed. The valve timing controller includes a first rotating element, which rotates in association with the drive shaft, and a second rotating element, which rotates in association with the driven shaft. The controller further includes a link mechanism part including arm members for coupling the first rotating element and the second rotating element as a revolute pair to change a relative rotational phase between the first rotating element and the second rotating element caused by motion of the revolute pair of the arm members. Additionally, the controller includes a gear part including a first gear and a second gear to convert outside rotating torque to control torque for the motion of the revolute pair of the arm members due to coupling of and planetary motion of one of the first and second gears relative to the other of the first and second gears. Moreover, the controller includes a separation member disposed between the gear part and the link mechanism part for separating a thrust gap of the gear part and a thrust gap of the link mechanism part.

BRIEF DESCRIPTION OF THE DRAWINGS

Other objects, features, and advantages will become more apparent from the following detailed description made with reference to the accompanying drawings, in which like portions are designated by like reference numbers and in which.

DETAILED DESCRIPTION

A valve timing controller in embodiments of the present invention will be hereinafter described with reference to the accompanying drawings.

First Embodiment

Figure 1:
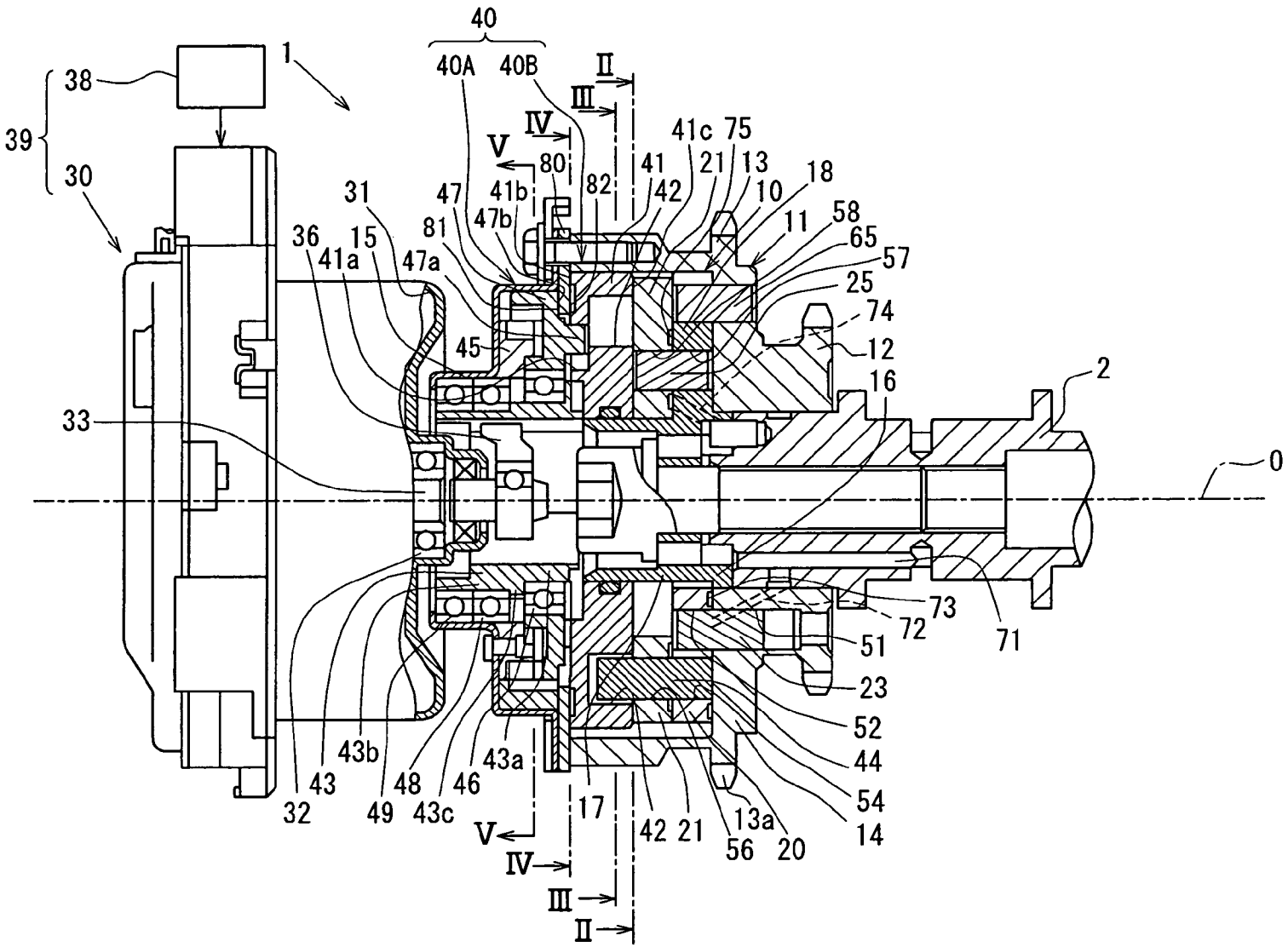
FIG. 1 is a cross sectional view of one embodiment of a valve timing controller.
Figure 2:
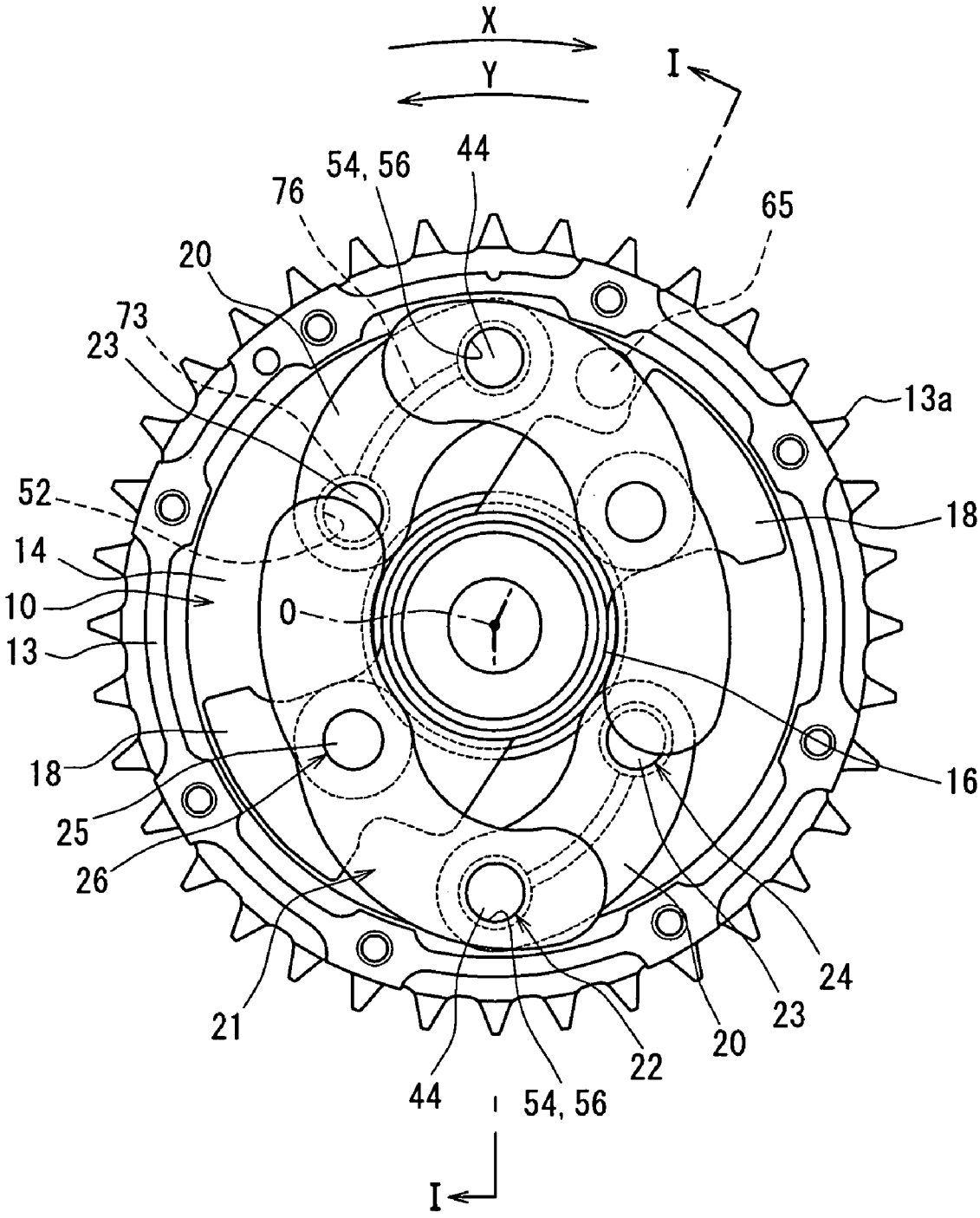
FIG. 2 is a cross sectional view of the valve timing controller taken on line II-II of FIG. 1.

FIG. 1 is a cross section taken on line I-I in FIG. 2. FIG. 2 shows a state in which a rotational phase is located in a phase position of the most retarded angle.

As shown in FIG. 1, in an internal combustion engine (hereinafter referred to as "engine"), a valve timing controller 1 is disposed in a transmission system, which transmits driving torque in a crankshaft (not shown) as a driving shaft to a camshaft 2 as a driven shaft. The valve timing controller 1 changes a relative rotational phase between the crankshaft and the camshaft 2, thus adjusting valve timing of an intake valve or an exhaust valve of the engine.

The valve timing controller 1 is provided with a phase changing mechanism 10 as a link mechanism part, an electric motor 30 and a motion changing mechanism 40 including a gear part 40A.

As shown in both FIG. 1 and FIG. 2, the phase changing mechanism 10 is arranged by combining a sprocket 11 as a driving rotating element, an output shaft 16 as a driven rotating element and arm members 20, 21. The phase changing mechanism 10 changes and adjusts a relative rotational phase between the rotating elements 11, 16 or between the crankshaft and the camshaft 2.

The sprocket 11 integrally includes a support cylindrical part 12, an input cylindrical part 13 which is larger in diameter than the support cylindrical part 12, and a link part 14 (hereinafter referred to as "first link part") which connects the support cylindrical part 12 and the input cylindrical part 13. The support cylindrical part 12 is disposed co-axially with the output shaft 16 and is rotatably supported by an outer peripheral wall. That is, the sprocket 11 rotates around a rotational center O and relatively to the output shaft 16.

A chain belt (not shown) is wound around and between a plurality of teeth 13*a* formed in the input cylindrical part 13 and a plurality of teeth formed in the crankshaft. When the driving torque of the crankshaft is inputted into the input cylindrical part 13 by the chain belt, the sprocket 11 rotates clockwise around the rotational center O of FIG. 2.

The output shaft 16 includes integrally a fixed part 17 and a second link part 18. One end of the fixed part 17 is fixed coaxially with one end of the camshaft 2. The output shaft 16 rotates around the rotational center O with the camshaft 2, and relatively to the sprocket 11. The second link part 18 is disposed at the right end of the output shaft 16 in the figure.

A cover 15 fixed in the input cylindrical part 13 and the link part 14 hold the arm members 20, 21 tightly with the link part 18 and each element 41, 44, 45, 47 of the motion converting mechanism 40 therebetween. The first arm member 20 engages with the link part 14 of the sprocket 11 by the revolute pair, while the second arm member 21 engages with the link part 18 and the first arm member 20 respectively by the revolute pair. By the engagements, the output shaft 16 rotates in the same direction as the sprocket 11 caused by rotation of the crankshaft.

The engagements enable the output shaft 16 to rotate in an advancement direction X and in a retard direction Y relatively to the sprocket 11. The arm members 20, 21 engage with a moving part 44 in the motion converting mechanism 40 by a revolute pair. In the phase changing mechanism 10, the revolute pair 22 formed of the arm members 20, 21 moves in association with the moving part 44, and the motion of this revolute pair 22 is to be converted into the relative rotational motion of the sprocket 11 and the output shaft 16.

As shown in FIG. 1, a control unit 39 as control means is composed of an electric motor 30, a power controlling circuit 38, etc. The electric motor 30 is disposed opposite to the camshaft 2 to interpose the rotating elements 11, 16 therebetween. In one embodiment, the electric motor 30 is an electric component such as a brushless motor, which includes a motor case 31 fixed to the engine through a stay (not shown) and a rotating shaft 33 (hereinafter referred to as "motor shaft") supported by a bearing 32 disposed in the motor case 31 so as to rotate in two directions.

The motor shaft 33 is disposed coaxially with the sprocket 11 and the output shaft 16 and has both axial ends supported by the bearing 32, and is also linked and fixed to an input shaft 43 through a shaft joint 36. The motor shaft 33 rotates with the input shaft 43 around the rotational center O.

The power control circuit 38 is constructed of an electric circuit such as a microcomputer and is disposed inside or outside of the motor case 31 to be connected electrically with the electric motor 30. The power control circuit 38 controls power supply to a coil of the electric motor 30 (not shown) in accordance with an engine operating condition or the like. This power supply causes the electric motor 30 to form a rotating magnetic field around the motor shaft 33 and to output the rotating torque in the directions X and Y (refer to FIG. 5) in accordance with the rotating magnetic field from the motor shaft 33.

As shown in FIG. 1, the motion converting mechanism 40 is constructed by combining the guide member 41, the moving part 44, the planetary gear 47, the input shaft 43, the ring gear 45, and bearings 46, 48, and 49.

Figure 3:
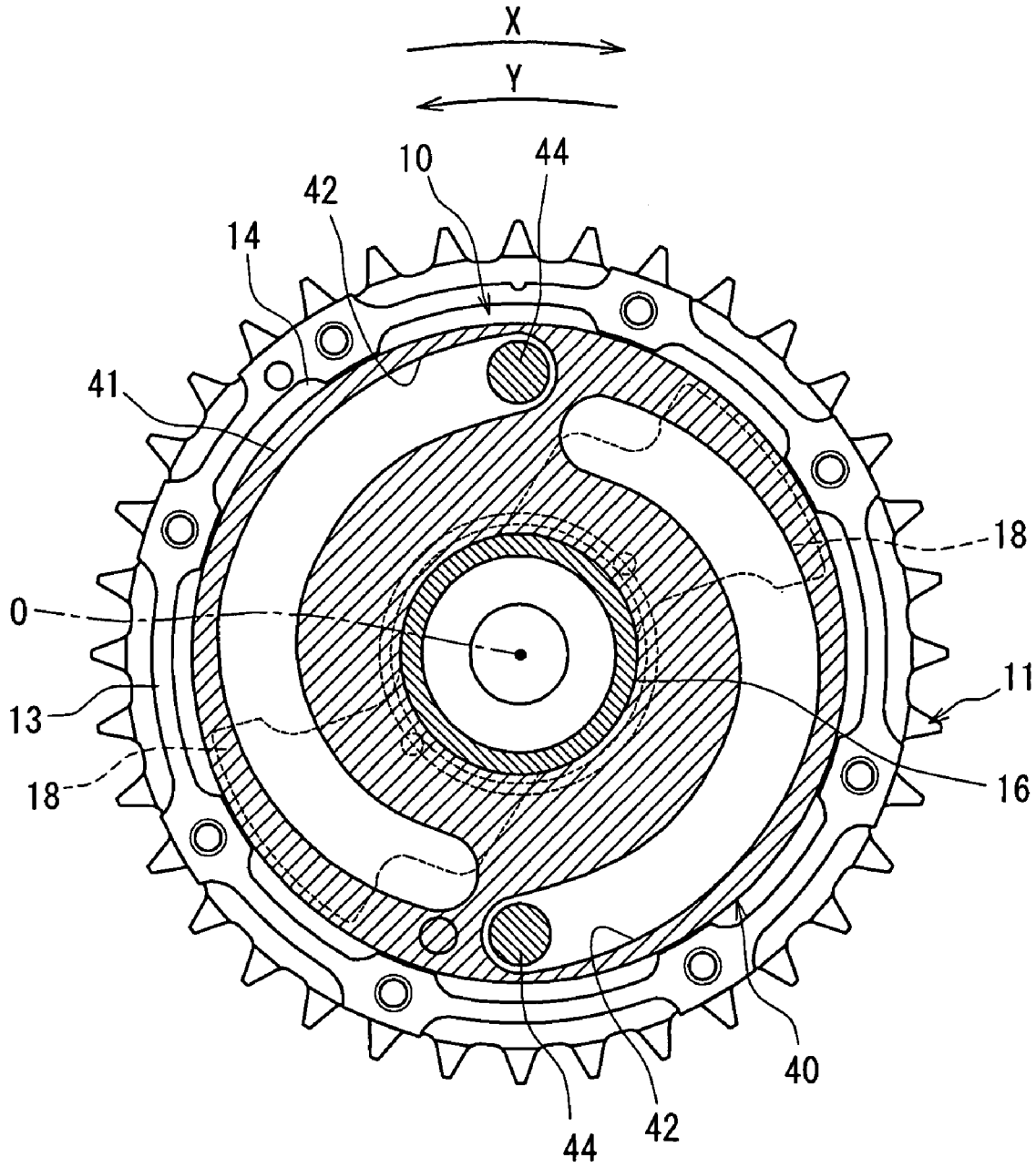
FIG. 3 is a cross sectional view taken on line III-III of FIG. 1.

As shown in FIGS. 1 and 3, the guide member 41 is formed in a circular ring plate shape coaxial with the output shaft 16 and is supported by the outer peripheral wall of the output shaft 16. The guide member 41 rotates around the rotational center O and in the directions X and Y relative to the sprocket 11. Guide passages 42 for guiding the moving member 44 are formed in an elongated shape at two locations of the guide member 41 sandwiching the rotational center O. Each guide passage 42 is formed so as to have the axial end face 41*c* of the guide member 41 (referred to as "arm member side-end face") as the bottom in the thickness direction and disposed in rotation symmetry of 180 degrees around the rotational center O as the symmetric axis.

As shown in detail in FIG. 3, in the arm member-side face 41*c*, the elongated bore of the each guide passage 42 is formed in a substantially spiral shape a radius of curvature of which gradually changes. It extends so as to be inclined to a radial axis of the guide member 41, and formed such that the distance from the rotational center O changes in the extending direction. In addition, the elongated shape of the directional passage 42 is not limited to this structure and may linearly extend so as to be inclined to the radial axis.

Figure 4:
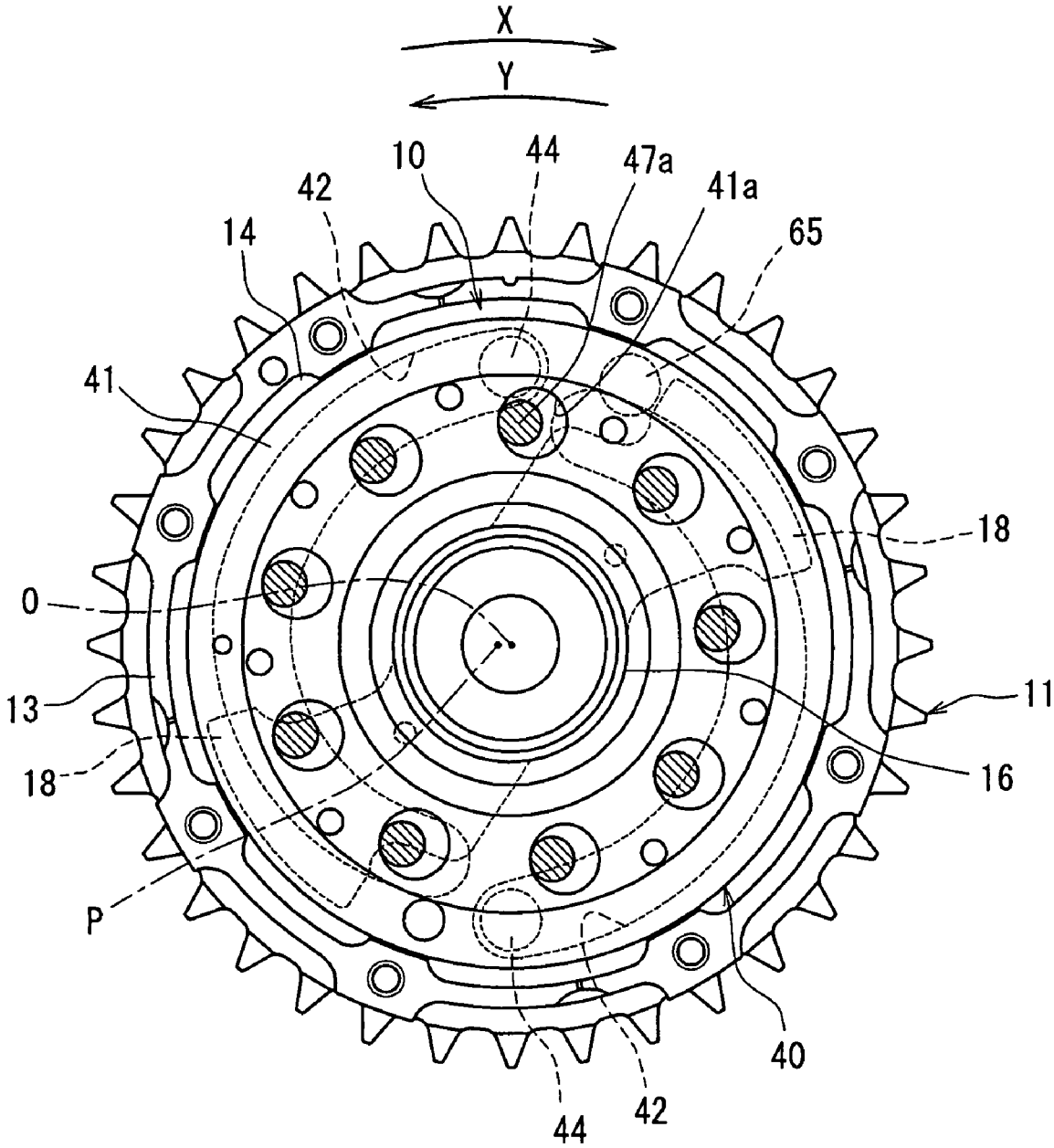
FIG. 4 is a cross sectional view taken on line IV-IV of FIG. 1.

As shown in FIGS. 1 and 4, the guide member 41 is provided with an engagement bore 41*a* opposite the arm members 20, 21 for guiding an engagement projection 47*a* of the planetary gear 47. More specifically, on an end face 41*b* (hereinafter referred to as "gear part side-end face") of the arm member part side-end face 41*c*, the engagement bores 41*a* are formed cylindrically at a plurality of locations of the guide member 41. Each engagement bore 41*a* is formed in such a manner as to have the guide member as the bottom in the thickness direction and are disposed in equal intervals around the rotational center O.

Two moving parts 44 are provided corresponding to the guide passage 42. Each moving part 44 is formed in a columnar shape and is held tightly between the link part 14 and the guide member 41 to be eccentric to the rotational center O. One end of each of the moving parts 44 fits and engages in the corresponding guide passage 42 by the sliding revolute pair. The other end of each of the moving parts 44 fits and engages in the corresponding arm member 20, 21 by the revolute pair.

Figure 5:
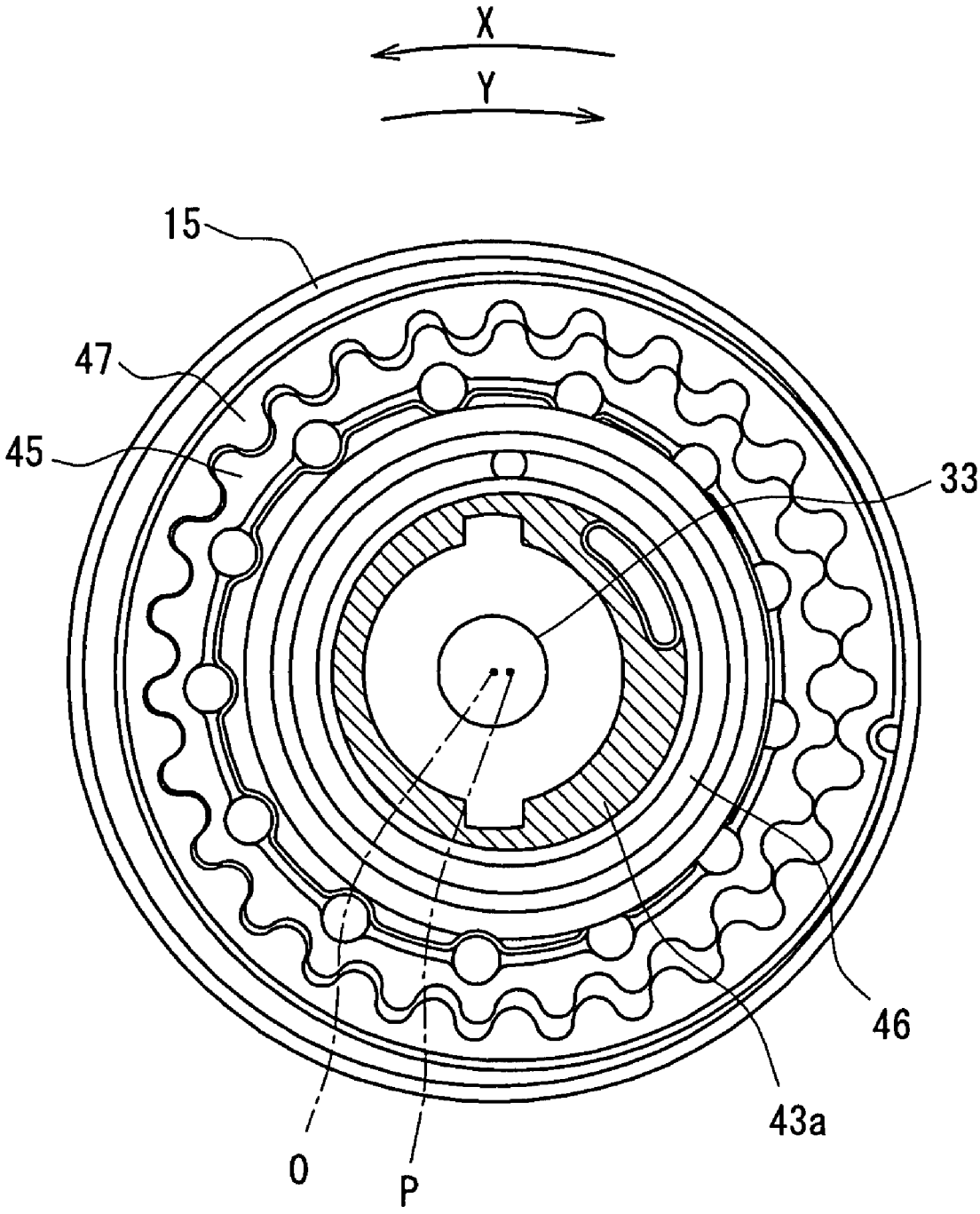
FIG. 5 is a cross sectional view taken on line V-V of FIG. 1.

As shown in FIGS. 1 and 5, an input part 43*b* of the input shaft 43 is a cylindrical shaft coaxial with the rotating elements 11, 16 and the camshaft 2, and is fixed to the motor shaft 33 through the shaft joint 36. As such, the input shaft 43 rotates around the rotational center O in association with movement of the motor shaft 33, and rotates relative to the sprocket 11. The input part 43*b* has the bearings 48, 49 attached to it, and it supports the ring gear 45 through the bearing 48, and also supports a cover 15 through the bearing 49. Therefore, the motor shaft 33, which is coupled with the input shaft 43, rotates in the X and Y directions relative to the sprocket 11.

In the input shaft 43, an output part 43*a* and a bearing 46 are fitted with a gap therebetween, and the gap is formed between an outer periphery of the output part 43*a* and an inner periphery of the bearing 46.

As shown in FIGS. 1 and 5, the input shaft 43 includes an output part 43*a*, which is cylindrical and is provided at the side of the support cylindrical part 12 from the input part 43*b*. The output part 43*a* has an outer peripheral wall eccentric to the rotating elements 11, 16, and the camshaft 2. The output part 43*a* supports the planetary gear 47 through the bearing 46.

In addition, the output part 43*a* of the output shaft 43 is connected and fixed to the motor shaft 33 to be eccentric to the rotational center O. P in FIG. 5 represents the center of the output part 43*a*.

The ring gear 45 is formed of an external gear with a tip curvature located at an outer periphery of a root curvature. A curvature radius of the tip curvature of the ring gear 45 is smaller than that of the root curvature of the planetary gear 47, and the number of teeth of the ring gear 45 is reduced by a prescribed number N (e.g., by one in this embodiment) as compared to the number of teeth of the planetary gear 47. The ring gear 45 is disposed in an interior side of the planetary gear 47, and a part of a plurality of teeth engages with a part of a plurality of teeth of the planetary gear 47. Therefore, the planetary gear 47 is able to make a planetary motion to the ring gear 45.

As shown in FIGS. 1 and 5, the planetary gear 47 is formed of an internal gear with a tip curvature located at an interior of a root curvature. The planetary gear 47 is provided with columnar engagement projections 47*a* at plural locations facing the respective engagement bores 41*a* of the guide member 41. The engagement projections 47*a* are provided at equal intervals around a center P of the input shaft 43, and protrude into the corresponding engagement bores 41*a*.

In such motion converting mechanism 40, when the motor shaft 33 does not rotate relative to the sprocket 11, the planetary gear 47 rotates together with the sprocket 11 and the input shaft 43 through rotation of the crankshaft, while maintaining the engagement position with the ring gear 45. Since the engagement projection 47*a* pushes the engagement bore 41*a* in the rotating direction, the guide member 41 rotates keeping the relative rotational phase to the sprocket 11. At this point, the moving part 44 does not slide relatively to the guide passage 42, and rotates with the guide member 41 maintaining a certain distance from the rotational center O.

However, when increasing control torque or the like causes the motor shaft 33 to rotate in the retard direction Y relatively to the sprocket 11, the planetary gear 47 changes an engaging position with the ring gear 45, while rotating relatively to the input shaft 43 by a planetary motion in a counter-clockwise direction in FIG. 5. An increasing force of the engagement projection 47*a* pushing the engagement bore 41*a* toward the rotating direction causes the guide member 41 to rotate in the advance direction X relative to the sprocket 11. At this point, the moving part 44 relatively slides along the guide passage 42, changing the distance from the rotational center O. For example, the moving member 44 relatively slides toward a side remote from the rotational center O to the guide passage 42, increasing the distance from the rotational center O.

However, when increasing control torque or the like causes the motor shaft 33 to rotate in the advance direction X relatively to the sprocket 11, the planetary gear 47 changes an engaging position with the ring gear 45, while rotating relatively to the input shaft 43 by a planetary motion in a clockwise direction in FIG. 5. Further, the engagement projection 47*a* is to push the engagement bore 41*a* toward the direction opposite the rotating direction, causing the guide member 41 to rotate in the retard direction Y relative to the sprocket 11. At this point, the moving part 44 relatively slides along the guide passage 42, changing the distance from the rotational center O. For example, the moving member 44 relatively slides toward a side near the rotational center O to the guide passage 42, reducing the distance from the rotational center O.

The motion converting mechanism 40 thus converts a rotating motion of the electric motor 30 into a motion of the moving part 44. The electric motor 30 and the motion converting mechanism 40 correspond to control means for controlling a motion of the revolute pair 22 moving in association with the moving part 44.

It should be noted that, in the motion converting mechanism 40, the gear parts 45, 47 aim at converting the outside rotating torque (the rotating torque of the electric motor 30) into the control torque for a motion of the revolute pair as a control object. The guide member 41 and the moving part 44 transmit the control torque from the gear parts 45, 47 to the arm members 20, 21 as a control object. Hereinafter, the guide member 41 and the moving part 44 are referred to as "transmission part 40B". In addition, the second link part 18, the first arm member 20, and the second arm member 21 constitute a phase changing mechanism 10.

Next, the phase changing mechanism 10 will be in detail explained referring to FIGS. 1 and 2. In the phase changing mechanism 10, the first arm member 20 is formed in an arched plate shape, and each is disposed at both sides sandwiching the rotational center O. The first link part 14 is formed in a circular-ring plate shape coaxial with the output shaft 16. Two locations in the link part 14 sandwiching the rotational center O contact ends of the corresponding respective first arm members 20, linking them through a shaft member 23. The shaft member 23 is columnar and eccentric to the rotational center O, and the first link part 14 and each of the first arm members 20 constitute the revolute pair 24 (hereinafter referred to as "first pair").

More specially, a bore part 51 is formed in a cylindrical shape at each of two locations sandwiching the rotational center line O in each first link part 14. A center line of the bore part 51 is eccentric to the rotational center line O. The two shaft members 23 are located in a position corresponding to the respective bore parts 51. One end of the each shaft member 23 fits with the corresponding bore part 51. A bore part 52 (hereinafter referred to as "first bore part") has a cylindrical shape and a centerline eccentric to the rotational center line O formed at one end in a longitudinal direction of each first arm member 20. The first bore part 52 of the first arm member 20 fits with the other end of the corresponding shaft member 23, enabling it to relatively rotate. Each first arm member 20 is located so as to contact the first link part 14 in a surrounding area of the first bore part 52 engaging with the shaft member 23. In the above embodiment, the first pair 24 formed of the first link part 14 and the first arm member 20 is arranged by an engagement of the bore parts 51, 52 formed in these elements 14, 20, and the shaft member 23.

The second arm member 21 is formed in an arched plate shape, and each of it is located respectively at both sides sandwiching the rotational center O. The second link part 18 is formed in a rectangular plate shape which extends toward a radial outside direction in opposing directions with each other from two locations sandwiching the rotational center O of the fixed part 17. With the intermediate portion of the extending direction in each of the second link parts 18, one end of the corresponding second arm member 21 contacts and moves in association through the shaft member 25. The shaft member 25 is columnar and eccentric to the rotational center O, and the second link part 18 and each of the second arm members 21 constitute the revolute pair 26 (hereinafter referred to as "second pair"). It should be noted that, in the first embodiment, the distance between each center of the second pair 26 and the rotational center is approximately equal.

More specially, a bore part 57 is formed in a cylindrical shape in each second link part 18, and a centerline of the bore part 57 is eccentric to the rotational centerline O. The two shaft members 25 are located corresponding to the respective bore parts 57 of the second link parts 18. One end of each shaft member 25 fits with the corresponding bore part 57. A bore part 58 (hereinafter referred to as "second bore part") having a cylindrical shape and a centerline eccentric to the rotational centerline O is formed at one end in a longitudinal direction of each second arm member 21. The second bore part 58 of the second arm member 21 fits with the other end of the corresponding shaft member 25, enabling it to relatively rotate. Each second arm member 21 is located so as to contact with the second link part 18 in a surrounding area of the second bore part 58 engaging with the shaft member 25. In the above embodiment, the second pair 26 formed of the second link part 18 and the second arm member 21 is arranged by an engagement of the bore parts 57 and 58 formed in the second link parts 18, the second arm member 21, and the shaft member 25.

An end in an opposite side of the second pair 26 of each second arm member 21 contacts with an end in an opposite side of the first pair 24 of the corresponding first arm member 20, and they move together through the moving part 44. The moving member 44 is columnar and eccentric to the rotational center O, and each first arm member 20 and each second arm member 21 constitute the revolute pair 22 (hereinafter referred to as "third pair").

More specially, a bore part 54 (hereinafter referred to as "first arm member-side third bore part") is formed in a cylindrical shape, a center line of which is eccentric to the rotational center line O is formed in the other end part in the longitudinal direction of each first arm member 20. A bore part 56 (hereinafter referred to as "second arm member-side third bore part") is formed in a cylindrical shape, a center line of which is eccentric to the rotational center line O is formed in the other end part in the longitudinal direction of each second arm member 21. The two moving members 44 are located corresponding to the first arm member-side third bore part 54. One end of the moving member 44 relatively rotatably fits with the corresponding first arm member-side third bore part 54. The other end of the moving member 44 relatively rotatably fits with the corresponding second arm member-side third bore part 56. Each second arm member 21 is located so as to contact the first arm member 20 in a surrounding area of the second arm member-side third bore part 56 engaging with the moving member 44. In the above first embodiment, the third pair 22 formed of the first arm member 20 and the second arm member 21 is arranged by an engagement of the bore parts 54, 56 formed in the first arm member 20, the second arm member 21, and the moving member 44.

In such phase changing mechanism 10, when the distance between the rotational center O and the moving part 44 is maintained, each location of the first, second and third pairs 24, 26, and 22 does not change. As a result, the output shaft 16 rotates with the camshaft 2, maintaining the relative rotational phase to the sprocket 11. Therefore the relative rotational phase of the camshaft 2 to the crankshaft is maintained to be constant.

On the other hand, when the distance between the rotational center O and the moving part 44 increases, for example when transferring from a state where a relative rotational phase of the output shaft 16 to the sprocket 11 becomes the most advance phase to a state where it becomes the most retard phase shown in FIG. 2, as the position of the third pair 22 moves away from the rotational center O, the first arm member 20 rotates relatively around each center of the shaft member 23 and the moving part 44 to the first link part 14 and the second arm member 21. At the same time, the second arm member 21 rotates relatively around a center of the shaft member 25 to the second link part 18, and a position of the second pair 26 moves closer to the retard direction Y to the position of the first pair 24. As a result, the output shaft 16 rotates in the retard direction Y relatively to the sprocket 11, which causes the retard of the relative rotational phase of the camshaft 2 to the crankshaft.

However, when the distance between the rotational center O and the moving part 44 reduces, for example when transferring from a state where a relative rotational phase of the output shaft 16 to the sprocket 11 becomes the most retard phase shown in FIG. 2 to a state where it becomes the most advance phase, as the position of the third pair 22 moves closer to the rotational center O, the first arm member 20 rotates relatively around each center of the shaft member 23 and the moving part 44 to the first link part 14 and the second arm member 21. At the same time, the second arm member 21 rotates relatively around a center of the shaft member 25 to the second link part 18, and a position of the second pair 26 moves away to the advance direction X from the position of the first pair 24. As a result, the output shaft 16 rotates in the advance direction X relative to the sprocket 11, which causes the advance of the relative rotational phase of the camshaft 2 to the crankshaft.

Next, a key part of the valve timing controller 1 will be explained in more detail.

As shown in FIG. 1, out of each element 11, 16, 20, 21 of the phase changing mechanism 10, the output shaft 16 and the arm members 20, 21 are disposed at the inner peripheral side of the sprocket 11 to be accommodated inside of the sprocket 11.

As shown in FIG. 1, out of the motion converting mechanism 40, each element 45, 47 of the gear part 40A is disposed at the inner peripheral side of the cover 15, and is accommodated inside of the sprocket 11. Also, each element 41, 44 of the transmission part 40B is disposed at the inner peripheral side of the sprocket 11 to be accommodated inside of the sprocket 11.

As shown in FIG. 1, a separation member 80 is provided between the elements 45, 47 of the gear part 40A and the elements 41, 44 of the transmission part 40B to separate the elements 45, 47 of the gear part 40A from the elements 41 and 44 of the transmission part 40B.

More specially, the separation member 80 made of a circular-ring plate member is interposed along and between an end face 47*b* of the planetary gear 47 and a gear part-side end face 41*b* of the guide member 41. The separation member 80 is screwed by the sprocket 11 so as to be interposed between the cover 15 and the sprocket 11. A first end face 81 out of both end faces 81, 82 of the separation member 80 is disposed to contact the end face 47*b* of the planetary gear 47 and the guide member 41 rotates relative to the separation member 80. In addition, a second end face 82 is disposed to contact the gear part-side end face 41*b* of the guide member 41 and the guide member 41 rotates relatively to the separation member 80.

Such separation member 80 axially separates the elements 45, 47 at the gear part 40A from the elements 41, 44 at the transmission part 40B by the corresponding first and second end faces 81 and 82. Thereby, at least the elements 45, 47, which determine a thrust gap of the gear part 40A and the elements 41, 44 that determine the transmission part 40B are separated. Therefore, the gear part 40A, the transmission part 40B, and the phase changing mechanism 10 are accommodated in the drive-side rotational elements 11 and 15 and the elements 45 and 47 which determine the thrust gap of the gear part 40A are separated from the elements 41, 18, 20, 21 which determine the thrust gap of the transmission part 40B and the phase changing mechanism 10.

In addition, in the first embodiment, it is preferable to dispose a division face between the sprocket 11 and the cover 15 as the drive-side rotating elements 11, 15, in a radial outside direction between the end faces 47*b*, 41 *b* as opposing faces of the gear part 40A and the transmission part 40B. Therefore, the separation member 80 is sandwiched between the sprocket 11 and the cover 15, and thereby the separation member 80 can be disposed to extend in a radial inside direction between the end face 47*b*, 41*b* of the gear part 40A and the transmission part 40B.

In addition, the sprocket 11 and the cover 15 are not limited to this kind of dividing rotation member parts, but it may be any kind of structure so long as the drive-side rotating elements 11, 15 are dividable between the gear part 40A and the transmission part 40B.

Further, in the first embodiment, the output part 43*a* of the input shaft 43 is designed to be disposed axially next to the output shaft 16. In the rotating elements 11, 16 whose relative rotational phase changes, the separation member 80 provided in an inside wall of the drive-side rotating elements 11, 15 allows the planetary gear 47 supported by the output part 43*a* to be easily separated from the transmission part 40B and the phase changing mechanism 10 supported by the output shaft 16.

In addition, in the first embodiment, for example a gap adjusting member such as a shim (not shown) of which the axial thickness can be selected is disposed in the thrust gap created by the elements 45, 47 of the gear part 40A. This makes it possible for the thrust controlling member to control the thrust gap. As a result, it is not necessary to improve precision of components such as the elements 45, 47 in order to reduce the thrust gap.

In addition, the element which determines the thrust gap of the gear part 40A is limited to the above mentioned elements 45, 47 by the separation member 80, and therefore it is possible to decrease the number of measurement points for the member locations at the time of controlling the thrust gap of the gear part 40A.

The first embodiment explained above is provided with the gear part 40A including the ring gear 45 and the planetary gear 47 to convert the outside rotating torque (the rotating torque of the electric motor 30) to the control torque for a motion of the revolute pair (the second pair 22) as a control object, the transmission part 40B including the guide member 41 to transmit the control torque to the arm members 20, 21, and the phase changing mechanism 10 including the arm members 20, 21 to change the relative rotational phase of the rotating members 11, 16 subject to the control torque.

In addition, the separation member 80 is provided between the gear part 40A and the link mechanism part 40B including the transmission 40B for axially separating the elements 45, 47 of the gear part 40A from the elements 41, 18, 20, 21 of the link mechanism parts 40B, 10.

Thereby, the elements (members) 45, 47, 41, 18, 20, 21 for determining the thrust gap in the gear part 40A and the link mechanism parts 40, 10 can be divided into the elements (members) 45, 47 for determining the thrust gap in the gear part 40A and the other elements (members) 41, 18, 20, 21.

According to the above arrangement, by interposing the separation member 80 between the gear part 40A and the link mechanism parts 40B, 10, it is possible to limit the thrust gap-determining elements (members) 45, 47, 41, 18, 20, 21 to the elements (members) 45, 47 which only determine the thrust gap of the gear part 40A, which enables a decrease in the number of members which determine the thrust gap of the gear part 40A.

As a result, the thrust gap variation of the gear part 40A can be effectively restricted. For example, in a case of restricting the thrust gaps in the elements (members) 45, 47, 41, 18, 20, 21 in order to prevent the thrust gap variation of the gear part 40A, it is required to improve precision of each element (member) because of a large number of elements which determine the thrust gap. However, a waste on a process of productivity is produced in a case of improving precision of the elements 45, 47 of the gear 40A and all of the other elements other than those. In contrast, in the first embodiment, the thrust gap variation of the gear part 40A can be restricted without improving the precision of the element. As a result, it is possible to reduce the thrust gap of the gear part 40A.

In the first embodiment, it is preferable to have at least one of the following three features. As a result, in the drive-side rotating elements 11 and 15 and the driven rotating element 16 whose relative rotational phase changes, it is possible to mount the separation member 80 to the sprocket 11 as one rotating element in a simple structure.

As for the first feature, in the first embodiment, in the gear part 40A and the link mechanism parts 40B, 10, the separation member 80 is formed with a circular-ring plate interposed between the end faces 47*b*, 41 *b* as opposing faces of the gear part 40A and the transmission part 40B. In addition, the separation member 80 is not limited to a structure of such circular-ring plate, but may be any extending plate such as one plate as long as it extends in a radial direction along and between the end faces 47*b*, 41 *b*.

As shown above, it is possible to form the separation member 80 with a simple extending element such as a single extending plate along and between the end faces 47*b*, 41 *b*, which extends to the extent it is interposed between the opposing faces 47*b*, 41 *b* of the gear part 40A and the transmission part 40B.

As for the second feature, in the first embodiment, the drive-side rotating elements 11, 15 accommodate the gear part 40A and the link mechanism parts 40B, 10 therein. As a result, as means of disposing the separation member 80 at the drive-side rotating elements 11, 15, it is possible to have such a simple structure as to hold the extending element extending in a radial inside direction between the gear part 40A and the link mechanism parts 40B, 10 with the inner wall of the sprocket 11 and the cover 15.

As for the third feature in the first embodiment, the drive-side rotating elements 11, 15 are composed of the sprocket 11 and the cover 15 as the separated rotating element which is able to be separated between the gear part 40A and the link mechanism parts 40B, 10, and the separation member (extending member) 80 is held tightly between the sprocket 11 and the cover 15. It is possible to have a simple assembled structure of fitting the separation member 80 in between the sprocket 11 and the cover 15 which are dividable between the gear part 40A and the link mechanism parts 40B, 10.

It should be noted that it is explained that the first embodiment includes the first to the third features, but it may include any one of them.

In the first embodiment explained above, the link mechanism parts 40B and 10 include the guide member 41 including the engagement bore 41*a* engaging with the engagement projection 47*a* of the planetary gear 47 of the gear 40A at the gear part-side end face 41*b* and including the guide passage 42 engaging (supported by the moving part 44) with the second pair 22 of the arm members 20, 21 at the arm member-side end face 41*c*. In addition, the gear part-side end face 41*b* is designed to produce the opposing face to the gear part 40A and the transmission part 40B.

As a result, the elements 41, 18, 20, 21 constituting the link mechanism 40B, 10 can be clearly separated from the elements 45, 47 constituting the gear part 40A through the separation member 80.

In the first embodiment, the output section 43*a* of the input shaft 43 is disposed to be axially next to the output shaft 16. With this arrangement, in the rotating elements 11, 16 whose relative rotational phase changes, it is possible to easily separate the planetary gear 47 supported by the output part 43*a* from the link mechanism parts 40B, 10 including the transmission part 40B supported by the output shaft 16, by the separation member 80 provided on the inner wall of the drive-side rotating elements 11, 15.

In the first embodiment, the gap adjusting member of which the axial thickness can be selected is located in the thrust gap between the elements 45 and 47 of the gear part 40A. As a result, it becomes possible for the gap adjusting member to adjust the thrust gap. It is not required to improve precision of the elements 45, 47 in order to reduce the thrust gap.

The elements for determining the thrust gap of the gear part 40A by the separation member 80 are limited to the elements 45, 47. Therefore, it is possible to decrease the number of measurement points at the member locations as the thrust gap object at the time of adjusting the thrust gap in the gear part 40A with the gap adjusting member.

Second Embodiment

The following paragraphs will describe other embodiments. In the following embodiments, components that correspond to those of the embodiment described above will be indicated with corresponding numerals.

In the first embodiment, the engagement relation between the gear part 40A and the guide member 41 is formed of the engagement projection 47*a* of the planetary gear 47 as the internal gear and the engagement bore 41*a* of the guide member 41.

Figure 6:
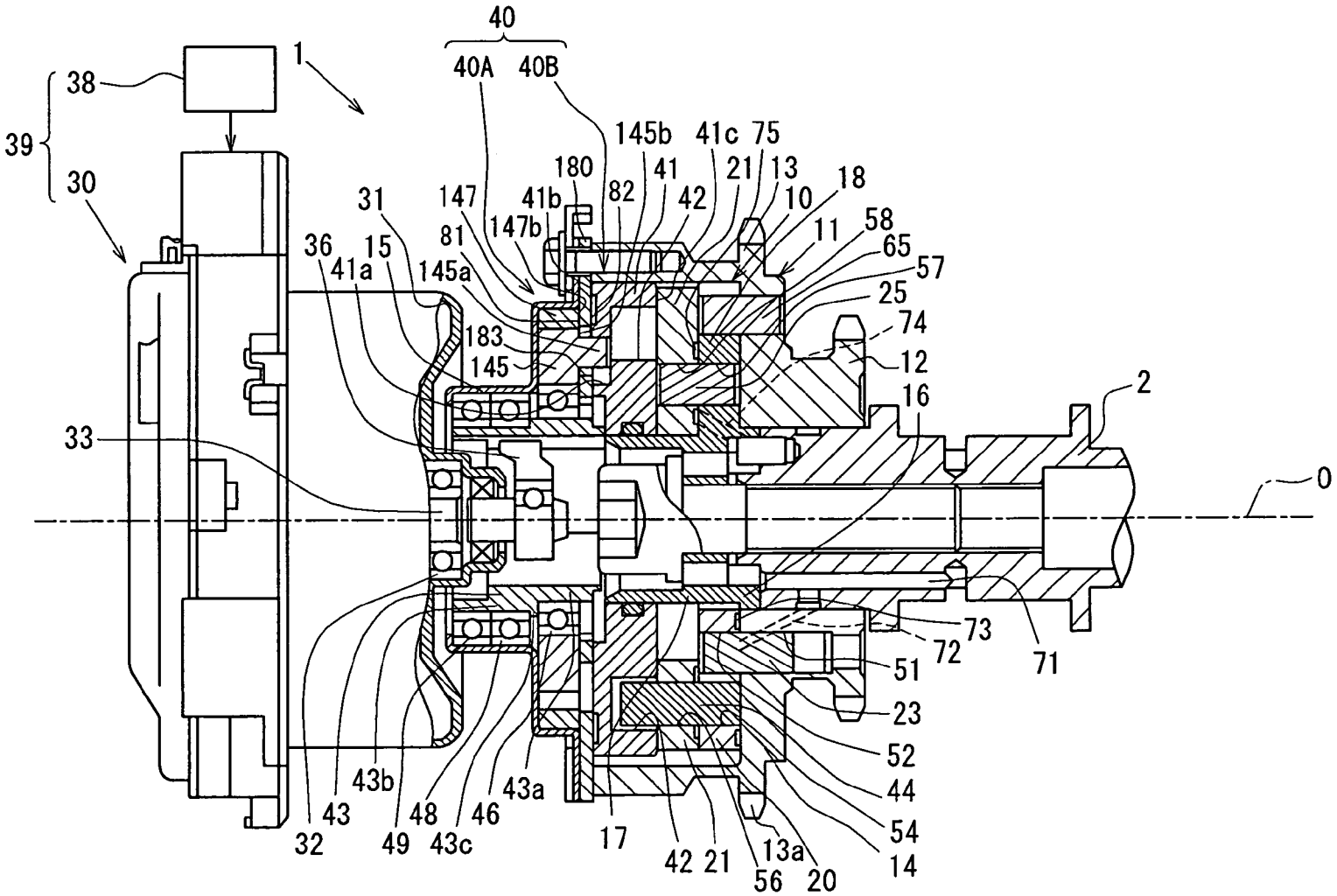
FIG. 6 is a cross sectional view showing another embodiment of the valve timing controller.

In contrast to the above, in the second embodiment, the engagement relation is formed of an engagement projection 145*a* provided in a planetary gear 145 as an external gear and the engagement bore 41*a* of the guide member 41. FIG. 6 is a cross section showing a valve timing controller in the second embodiment.

As shown in FIG. 6, a gear 40A includes a planetary gear 145 and a ring gear 147. The planetary gear 145 is supported by an input shaft 43 through a bearing 46. On the other hand, the ring gear 147 is fixed coaxially on an inner wall of a cover 15, which makes it possible for the ring gear 147 to rotate with a sprocket 11 around a rotational center O.

In the second embodiment, a separation member 180 is formed in a circular-ring plate and the engagement projection 145*a* includes an opening part (hereinafter referred to as "engagement window") 183 for axial insert. The separation member 180 extends out in a radial inside direction between an end face 147*b* of the ring gear 147 and an end face 145*b* of the planetary gear 145, and a gear part-side end face 41*b* of the guide member 41.

Such arrangement can also achieve the same effect as the first embodiment.

In addition, the separation member 180 may be provided with an engagement window for each engagement projection 145*a*, or may be provided with an engagement window for a plurality of the engagement projections 145*a*. If the size of the inner periphery of the circular-ring-shaped separation member 180 is larger than the radial position of the engagement projection 145*a*, the separation member 180 may not be provided with the engagement window.

Other Embodiments

As described above, the embodiments of the present invention are explained. However, the present invention is not to be limited to the above interpretation for the embodiments, but is able to be applied to various embodiments within the spirit of the intended purpose of the present invention.

(1) In the embodiments mentioned above, the valve timing controller 1 which controls intake valve timing is explained. However, this present invention may be applied to a device for controlling exhaust valve timing, or a device for controlling both intake and exhaust valve timing. In addition, the above embodiments explain the valve timing controller 1 in which the sprocket 11 of the first rotating element is linked in motion to the crankshaft, and the output shaft 16 of the second rotating element is linked in motion to the camshaft 2, but the first rotating element may be linked in motion to the camshaft and the second rotating element may be linked in motion to the crankshaft.

(2) In the above embodiments, the drive-side rotating elements 11 and 15 are explained as elements separated as the sprocket 11 and the cover 15. However, it may be elements which are able to be separated as three drive-side rotating element parts, or may have any structure which is able to be separated as at least two. As a result, it becomes possible to fit the separation member into between any separated rotating element parts among the separated rotating element parts (3) In the above embodiments, the elements (members) 45, 47, 41, 18, 20, 21 which determine the thrust gap of the gear part 40A and the link mechanism parts 40B, 10 are divided into the elements (members) 45, 47 which determine the thrust gap of the gear part 40A, and the elements (members) 41, 18, 20, 21 other than those by interposing the separation member 180 between the end faces 47*b* and 145*b* of the gear part 40A and the gear part-side end face 41*b* of the link mechanism parts 40B and 10.

The separation member is not limited to the above-mentioned embodiment, but for example, the separation member may be interposed between the arm member-side end face 41*c* of the transmission member and the arm members 20 and 21, in order to separate the elements 45, 47, 41 of the gear part 40A and the transmission part 40B from the elements 20 and 21 of the phase changing mechanism 10.

(4) In the above embodiments, it is explained that the gap adjusting member is disposed in the thrust gap of each element 45, 47 of the gear part 40A. However, it may be disposed in the thrust gap of each element 41, 18, 20, 21 of the link mechanism parts 40B, 10. In this case, it is possible to decrease the number of the measurement points of the member locations as the thrust gap object, in the case of desiring to adjust the thrust gap of the link mechanism parts 40B, 10 by the gap adjusting member.

While only the selected example embodiments have been described, it will be apparent to those skilled in the art that various changes and modifications can be made therein without departing from the scope of the present disclosure. Furthermore, the foregoing description of the example embodiments is provided for illustration only, and not for the purpose of limiting the disclosure as defined by the appended claims and their equivalents.

What is claimed is:

1. A valve timing controller disposed in a drive system which transmits torque of a drive shaft to a driven shaft for opening and closing of a valve to thereby control opening and closing timing of the valve, the valve timing controller comprising:

a first rotating element which rotates in association with the drive shaft;

a second rotating element which rotates in association with the driven shaft;

a link mechanism part including arm members for coupling the first rotating element and the second rotating element as a revolute pair to change a relative rotational phase between the first rotating element and the second rotating element caused by motion of the revolute pair of the arm members;

a gear part including a first gear and a second gear to convert outside rotating torque to control torque for the motion of the revolute pair of the arm members due to coupling of and planetary motion of one of the first and second gears relative to the other of the first and second gears; and a separation member disposed between the gear part and the link mechanism part for separating a thrust gap of the gear part and a thrust gap of the link mechanism part, wherein:

the separation member is provided at one of the first rotating element and the second rotating element, the gear part includes a face and the link mechanism part includes an axial end face that opposes the face of the gear part, and the separation member extends radially along and between the face of the gear part and the axial end face of the link mechanism part.

2. A valve timing controller according to claim 1, wherein the one of the first rotating element and the second rotating element accommodates the link mechanism part and the gear part therein.

3. A valve timing controller according to claim 1, wherein the one of the first rotating element and the second rotating element includes division rotating element parts divided between the gear part and the link mechanism part, and the division rotating element parts hold the separation member therebetween.

4. A valve timing controller according to claim 1, wherein:

the link mechanism part includes a guide member with the axial end face, engaging with one of the first gear part and the second gear part, and an opposite end face that is opposite to the axial end face and that engages with the arm members.

5. A valve timing controller according to claim 1, further comprising:

an input shaft on which outside rotating torque acts, wherein:

the input shaft supports the gear part so as to be rotated relatively thereto and is axially adjacent one of the first rotating element and the second rotating element.

6. A valve timing controller according claim 1, wherein:

the thrust gap of at least one of the gear part and the link mechanism part is adjusted by a gap adjusting member.

* * * * *